US009772584B2

(12) United States Patent
Aiba

(10) Patent No.: US 9,772,584 B2
(45) Date of Patent: Sep. 26, 2017

(54) IMAGE FORMING APPARATUS

(71) Applicant: CANON KABUSHIKI KAISHA, Tokyo (JP)

(72) Inventor: Shozo Aiba, Tsukubamirai (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/234,221

(22) Filed: Aug. 11, 2016

(65) Prior Publication Data

US 2017/0060041 A1 Mar. 2, 2017

(30) Foreign Application Priority Data

Aug. 28, 2015 (JP) ..... 2015-169854

(51) Int. Cl.
*G03G 15/16* (2006.01)

(52) U.S. Cl.
CPC ..... *G03G 15/1615* (2013.01)

(58) Field of Classification Search
CPC ..... G03G 15/1615
See application file for complete search history.

(56) References Cited

U.S. PATENT DOCUMENTS 6,697,595 B2 2/2004 Kawagoe et al.
9,188,910 B2 11/2015 Yoshioka
2007/0059055 A1* 3/2007 Iwata ..... G03G 15/1615 399/302
2009/0028615 A1* 1/2009 Inoue ..... G03G 15/1615 399/313
2011/0081188 A1* 4/2011 Kaseda ..... G03G 15/1605 400/611
2012/0076554 A1* 3/2012 Kaseda ..... G03G 15/161 399/316
2012/0263500 A1* 10/2012 Saka ..... G03G 15/167 399/177
2014/0294408 A1* 10/2014 Yoshioka ..... G03G 15/1615 399/44
2014/0294411 A1* 10/2014 Yoshioka ..... G03G 15/1695 399/45

(Continued)

FOREIGN PATENT DOCUMENTS

JP 2002-082543 A 3/2002
JP 2010-134167 A 6/2010

(Continued)

*Primary Examiner* — G. M. Hyder
(74) *Attorney, Agent, or Firm* — Fitzpatrick, Cella, Harper & Scinto

(57) ABSTRACT

An image forming apparatus includes a toner image forming portion, an endless belt, first, second, and third rollers, and an urging roller, and satisfies: 25 (mm)>X>$(R1+R2)^2-(R1-R2)^2)^{1/2}-L1)+7$ (mm), 3.5 (mm)≥Y>0.5 (mm), and L1>0 (mm). X is a distance between Lb passing through a rotation center of the third roller and perpendicular to an outer common tangential line L between the first and second rollers and Lc passing through a rotation center of the urging roller and L, R1 is a radius of the first roller, R2 is a radius of the urging roller, L1 is a distance between Lb and a line La passing through a rotation center of the first roller and L, and Y is a distance between L and a tangential line Ld of the urging roller parallel to L.

12 Claims, 7 Drawing Sheets

(56) References Cited

U.S. PATENT DOCUMENTS

| | | | | |
|---|---|---|---|---|
| 2015/0125189 | A1* | 5/2015 | Hozumi | G03G 15/1615 399/308 |
| 2015/0314976 | A1* | 11/2015 | Hozumi | G03G 15/1615 198/806 |
| 2016/0062279 | A1* | 3/2016 | Hozumi | G03G 15/1605 399/313 |

FOREIGN PATENT DOCUMENTS

| | | | |
|---|---|---|---|
| JP | 2014-191100 | A | 10/2014 |
| JP | 2015-165291 | A | 9/2015 |

* cited by examiner

IMAGE FORMING APPARATUS

FIELD OF THE INVENTION AND RELATED ART

The present invention relates to an image forming apparatus, such as a copying machine, a facsimile machine or a printer, using an electrophotographic type or an electrostatic recording type.

Conventionally, in the image forming apparatus using the electrophotographic type or the electrostatic recording type, there is an image forming apparatus using an image bearing member, constituted by an endless belt extended around and stretched by a plurality of supporting rollers, for carrying and feeding a toner image. As the belt-shaped image bearing member, a belt-shaped electrophotographic photosensitive member (photosensitive (member) belt), a belt-shaped electrostatic recording dielectric member (electrostatic dielectric (member) belt), an intermediary transfer member (intermediary transfer belt) onto which the toner image is transferred from the photosensitive member or the electrostatic dielectric member, and the like exist. As a transfer method of transferring the toner image from the belt onto a recording material (medium) such as paper, there is a method in which a transfer electric field is formed at a transfer portion (transfer nip) by a roller (outer transfer roller) for forming the transfer portion in contact with an outer peripheral surface of the belt and then the toner image is transferred onto the recording material passing through the transfer portion.

The image forming apparatus of the intermediary transfer type will be further described as an example. The image forming apparatus of the intermediary transfer type includes the intermediary transfer belt as the belt-shaped image bearing member. Further, correspondingly to an inner secondary transfer roller which is one of the plurality of supporting rollers, an outer secondary transfer roller for forming a secondary transfer portion (secondary transfer nip) in contact with an outer peripheral surface of the intermediary transfer belt is provided. Further, for example, a secondary transfer bias of an opposite polarity of a charge polarity of the toner is applied to the outer secondary transfer roller (or a secondary transfer bias of the same polarity as the charge polarity of the toner is applied to the inner secondary transfer roller), so that the toner image is transferred from the intermediary transfer belt onto the recording material passing through the secondary transfer portion.

Such an image forming apparatus is required to form images on various recording materials in some cases. For example, the image forming apparatus is required to meet a recording material such as embossed paper having a feature of material feeling in some cases. The recording material represented by the embossed paper and having low smoothness is in general a recording material onto which the toner image is not readily transferred from the intermediary transfer belt. In the case where unevenness (projections and recesses) of several 10 μm or more exists on the surface of the recording material, at a recessed portion of the recording material, the intermediary transfer belt and the recording material cannot contact each other and a gap therebetween is formed in some cases. This phenomenon can generate even in a constitution in which the secondary transfer bias is applied while pressing the recording material against the intermediary transfer belt by the outer secondary transfer roller constituted by, e.g., an electroconductive rubber roller. Further, by the application of the secondary transfer bias, electric discharge can generate in the above-described gap.

When the toner on the intermediary transfer belt is subjected to the electric discharge in the neighborhood of the secondary transfer portion, the electric charge of the toner is removed (charge removal) or increased (charge-up) in some cases. For that reason, a charge amount distribution of the toner on the intermediary transfer belt is broadened, with the result that an electrostatic transfer property at the secondary transfer portion is impaired.

Also with respect to a recording material with surface unevenness smaller than the surface unevenness of the embossed paper, a similar phenomenon generates in the case where the intermediary transfer belt which is rotationally driven (fed) is unstable in attitude due to vibration or waving in the neighborhood of the secondary transfer portion. This is also true for the case where the attitude of the recording material is unstable in the neighborhood of the secondary transfer portion. That is, an adhesive property between the recording material and the intermediary transfer belt is impaired, so that the charge amount distribution of the toner on the intermediary transfer belt is broken by the electric discharge generated in the neighborhood of the secondary transfer portion. Then, the toner which does not follow an electrostatic force acting on the recording material at the secondary transfer portion increases, so that a transfer property of the toner image onto the recording material is impaired.

In order to solve the problems, Japanese Laid-Open Patent Application (JP-A) 2002-082543 and JP-A 2010-134167 propose a constitution in which a member for holding an attitude of the intermediary transfer belt from an inner peripheral surface side of the intermediary transfer belt in the neighborhood of the secondary transfer portion is provided. By employing such a constitution, the intermediary transfer belt is urged (pressed) from the inner peripheral surface side in a side upstream of the secondary transfer portion, so that vibration and waving of the intermediary transfer belt in the side upstream of the secondary transfer portion are suppressed. For that reason, the electric discharge in the side upstream of the secondary transfer portion is suppressed, so that deterioration of the transfer property as described above is suppressed. Incidentally, herein, "upstream (side)" and "downstream (side)" refer to those with respect to a belt feeding direction (movement direction).

However, in the above-described constitution in which the intermediary transfer belt is urged from the inner peripheral surface side in the side upstream of the secondary transfer portion, it turned out that the following problems occurred.

That is, in the case where a recording material such as thick paper having relatively high stiffness (rigidity) is used, when the recording material enters the secondary transfer portion (at a leading end portion of the recording material) or when the recording material comes out of the secondary transfer portion (at a trailing end portion of the recording material), the adhesive property between the recording material and the intermediary transfer belt is temporarily impaired in some cases. As a result, a phenomenon that the toner image is disturbed generates in some cases. Further, a phenomenon which is called white void (or white flower) such that abnormal electric discharge generates due to separation between the recording material and the intermediary transfer belt generates in some cases. These phenomena will be further described.

FIG. 9 is a schematic longitudinal sectional view of a neighborhood of a secondary transfer portion T2. An outer secondary transfer roller 24 is disposed opposed to an inner secondary transfer roller 23 via an intermediary transfer belt 5. In an example of FIG. 9, the outer secondary transfer roller 24 is disposed so as to be shifted (offset) toward an upstream side relative to the inner secondary transfer roller 23. For that reason, a contact region between the outer secondary transfer roller 24 and the intermediary transfer belt 5 is positioned upstream of a contact region between the inner secondary transfer roller 23 and the intermediary transfer belt 5. In FIG. 9, a direction (line) perpendicular to a line connecting a center of the outer secondary transfer roller 24 and a center of the inner secondary transfer roller 23 is defined as a "nip line". As long as a recording material P is in a state in which the recording material P is sandwiched between the outer secondary transfer roller 24 and the intermediary transfer belt 5 at the secondary transfer portion T2, an attitude of the recording material P is intended to be maintained substantially along the nip line. However, a status is different when the recording material P enters the secondary transfer portion T2 (at a leading end portion of the recording material P) or when the recording material P comes out of the secondary transfer portion T2 (at a trailing end portion of the recording material P).

First, the status when the recording material P comes out of the secondary transfer portion T2 will be described. Immediately before the recording material P comes out of the secondary transfer portion T2, the trailing end portion of the recording material P is separated from a guiding member 26 positioned in a side upstream of the secondary transfer portion T2, and a force along the nip line acts on the recording material P at a portion from a position of the recording material P at the secondary transfer portion T2 to the trailing end portion of the recording material P. For that reason, the trailing end portion of the recording material P pushes up the surface of the intermediary transfer belt 5 (i.e., moves the intermediary transfer belt 5 in an inner peripheral surface direction), so that the recording material P behaves so that the intermediary transfer belt 5 and the recording material P separate from each other (a portion of an arrow A in FIG. 10) as shown in FIG. 10. Particularly, in the case where the contact region between the outer secondary transfer roller 24 and the intermediary transfer belt 5 is positioned upstream of the contact region between the inner secondary transfer roller 23 and the intermediary transfer belt 5, the nip line bites into the inner peripheral surface side relative to the surface of the intermediary transfer belt 5, and therefore, the above-described phenomena are conspicuous. Further, when in the neighborhood of the secondary transfer portion T2, a member 25 for supporting the intermediary transfer belt 5 from the inner peripheral surface side of the intermediary transfer belt 5 is provided, in order to maintain the attitude of the intermediary transfer belt 5, as shown in FIG. 11, the intermediary transfer belt 5 forms a part of a loop (at a portion of an arrow B in FIG. 11).

Next, the status when the recording material P enters the secondary transfer portion T2 will be described. Immediately before the leading end portion of the recording material P reaches the secondary transfer portion T2, a certain angle is provided between the recording material P and the intermediary transfer belt 5, and therefore, the recording material P intends to change the attitude thereof at the instance when the recording material P is sandwiched at the secondary transfer portion T2. At that time, similarly as in the case of FIG. 10, a force acts on the recording material P in a direction (inner peripheral surface direction) in which the recording material P pushes up the intermediary transfer belt 5, and therefore the intermediary transfer belt 5 moves in a direction in which the intermediary transfer belt 5 is spaced from the recording material P. Further, at this time, when in the neighborhood of the secondary transfer portion T2, the member 25 for supporting the intermediary transfer belt 5 from the inner peripheral surface side of the intermediary transfer belt 5 is provided in order to maintain the attitude of the intermediary transfer belt 5, similarly as in the case of FIG. 11, the intermediary transfer belt 5 forms the part of the loop.

Consequently, in the case where the member 25 for supporting the intermediary transfer belt 5 from the inner peripheral surface side is provided in the neighborhood of the secondary transfer portion T2, the behavior of the recording material P when the recording material P passes through the secondary transfer portion T2 is as follows in some cases.

First, the leading end portion of the recording material P once contacts the intermediary transfer belt 5 before the recording material P reaches the secondary transfer portion T2. However, at the instance when the recording material P is sandwiched at the secondary transfer portion T2, the intermediary transfer belt 5 spaces from the recording material P and forms the above-described loop in some cases. Thereafter, when the leading end portion of the recording material P reaches a central portion of the secondary transfer portion T2, the above-described loop is eliminated, so that the recording material P and the intermediary transfer belt 5 extend in the same direction. Thus, at the leading end portion of the recording material P, by a process in which the recording material P and the intermediary transfer belt 5 contact each other and separate from each other, and then contact each other again, scattering of the toner on a white background portion (disturbance of the toner image) generates in some cases. Particularly, in a halftone image, this tendency is conspicuous. As a result, the image on the recording material P at the leading end portion becomes a blur image (blur phenomenon) such that the toner scatters onto a white background portion surrounding a dot image.

Further, also at the trailing end portion of the recording material P, the intermediary transfer belt 5 separates from the recording material P and forms the loop as described above. For that reason, at the trailing end portion of the recording material P, the intermediary transfer belt 5 separates from the recording material P, so that abnormal electric discharge generates and a charge polarity of the toner is locally inverted, and thus the white void such that the toner cannot be electrostatically transferred onto the recording material P generates in some cases.

The phenomenon as described above is conspicuous in the case of thick paper (both of coated paper and non-coated paper) which has relatively high stiffness and relatively large thickness.

SUMMARY OF THE INVENTION

According to an aspect of the present invention, there is provided an image forming apparatus comprising: a toner image forming portion configured to form a toner image; a movable endless belt on which the toner image is formed by the toner image forming portion and from which the toner image is transferred onto a recording material at a transfer portion; a plurality of rollers contacting an inner peripheral surface of the belt and including a first roller, an urging roller and a second roller, wherein the first roller is provided at the transfer portion, the urging roller is provided at a position upstream of and adjacent to the first roller with respect to a movement direction of the belt and urges the belt from the inner peripheral surface toward an outer peripheral surface of the belt, and the second roller is provided at a position upstream of and adjacent to the urging roller and downstream of the toner image forming portion with respect to the movement direction of the belt; and a third roller provided at a position opposing the first roller through the belt, wherein the following relationships are satisfied: 25 (mm) $>X>(((R1+R2)^2-(R1-R2)^2)^{1/2}-L1)+7$ (mm), 3.5 (mm) $\geq Y>0.5$ (mm), and $L1>0$ (mm), wherein as seen in a rotational axis direction of the first roller, X is a distance (mm) between Lb and Lc, where Lb is a rectilinear line passing through a rotation center of the third roller and perpendicular to an outer common tangential line L between the first roller and the second roller in a side contacting the belt, and Lc is a rectilinear line passing through a rotation center of the urging roller and perpendicular to the outer common tangential line L, R1 is a radius (mm) of the first roller, R2 is a radius (mm) of the urging roller, L1 is a distance (mm) between the rectilinear line Lb and a rectilinear line La passing through a rotation center of the first roller and perpendicular to the outer common tangential line L with the proviso that L1 is a positive value when Lb is positioned upstream of La with respect to the movement direction of the belt, and Y is a distance (mm) between the outer common tangential line L and a tangential line Ld of the urging roller parallel to the outer common tangential line L in a side contacting the belt.

Further features of the present invention will become apparent from the following description of exemplary embodiments with reference to the attached drawings.

DESCRIPTION OF THE EMBODIMENTS

An image forming apparatus according to the present invention will be described with reference to the drawings.

Embodiment 1

1. General Constitution and Operation of Image Forming Apparatus

Figure 1:
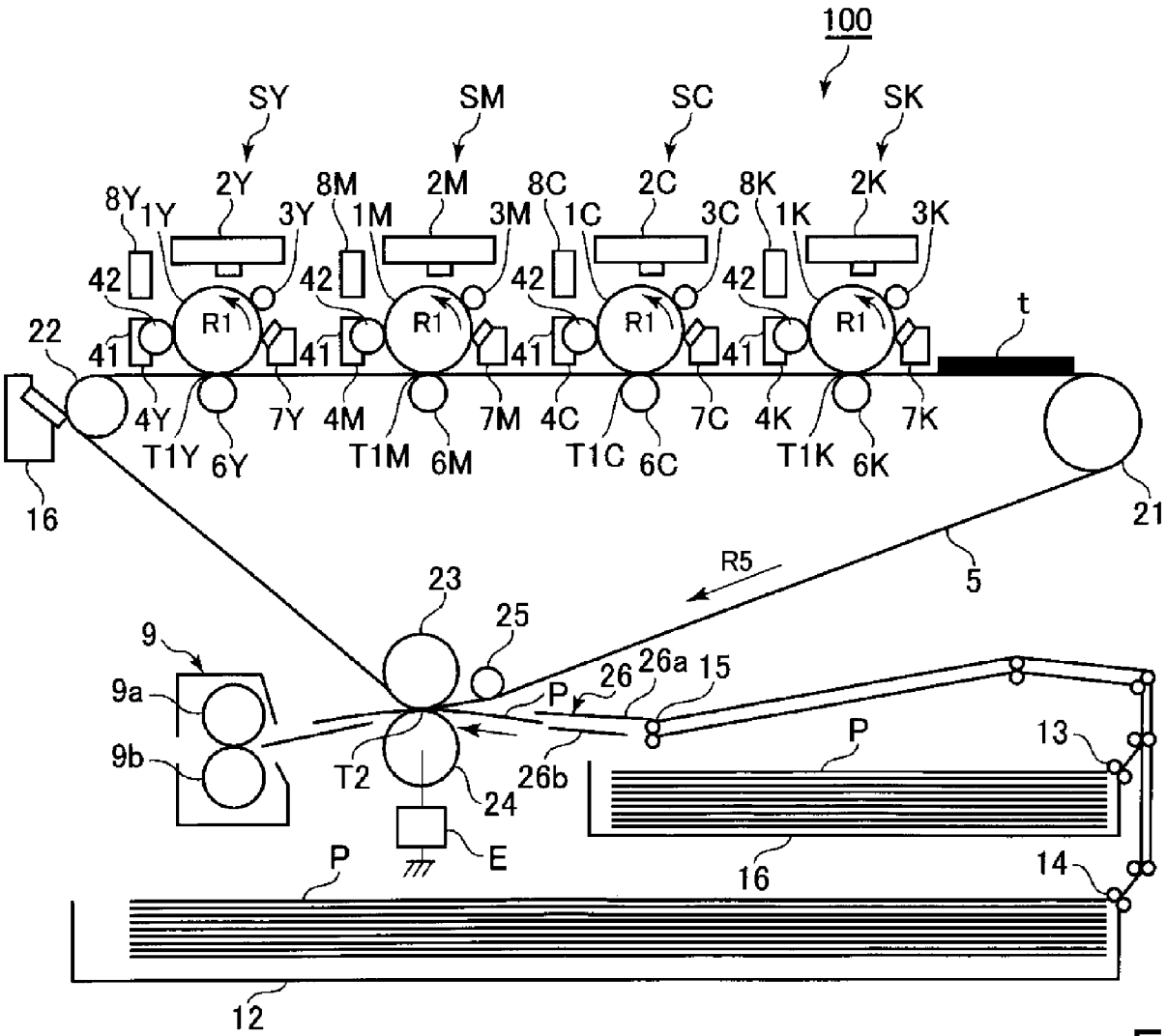
FIG. 1 is a schematic longitudinal sectional view of an image forming apparatus.

FIG. 1 is a schematic longitudinal sectional view of an image forming apparatus 100 according to Embodiment 1 of the present invention.

The image forming apparatus 100 in this embodiment is a tandem image forming apparatus which is capable of forming a full-color image using an electrophotographic type and which employs an intermediary transfer type.

The image forming apparatus 100 includes, as a plurality of image forming portions (stations), first to fourth image forming portions SY, SM, SC and SK for forming toner images of yellow (Y), magenta (M), cyan (C) and black (K), respectively. In this embodiment, constitutions and operations of the first to fourth image forming portions SY, SM, SC and SK are substantially the same except that the colors of toners used in a developing step described later are different from each other. Accordingly, in the following, in the case where particular distinction is not required, suffixes Y, M, C and K for representing elements for associated colors are omitted, and the elements will be collectively described.

The image forming portion S includes a photosensitive drum 1 which is a drum-shaped electrophotographic photosensitive member as a first image bearing member. In this embodiment, the photosensitive drum 1 is constituted by applying a layer of an OPC (organic photoconductive) as a photosensitive layer onto an outer peripheral surface of an aluminum cylinder of 30 mm in outer diameter. The photosensitive drum 1 is rotationally driven in an arrow R1 direction. At a periphery of the photosensitive drum 1 of the image forming portion S, the following devices are provided in the listed order. First, a charging roller 3 as a roller-shaped charging member is disposed. Next, an exposure device (laser scanner) 2 as an exposure means is disposed. Next, a developing device 4 as a developing means is disposed. Next, a primary transfer roller 6 which is a roller-shaped primary transfer member as a primary transfer means. Next, a drum cleaner 7 as a photosensitive member cleaning means is disposed.

A surface of the rotating photosensitive drum 1 is electrically charged substantially uniformly to a predetermined polarity and a predetermined potential by the charging roller 3. The charging roller 13 is disposed in contact with the photosensitive drum 1 and electrically charges the peripheral surface of the photosensitive drum 1 uniformly to a predetermined negative polarity by being supplied with a superposed voltage as a charging bias (charging voltage) in the form of an AC voltage and a negative DC voltage in this embodiment. The charged photosensitive drum 1 is subjected to laser light irradiation by the exposure device 2, so that an electrostatic latent image (electrostatic image) corresponding to a color of an associated image forming portion S is formed. The electrostatic latent image formed on the photosensitive drum 1 is developed (visualized) as a toner image by deposition of the toner as a developer by the developing device 4. The developing devices 4Y, 4M, 4C and 4K of the respective image forming portions S accommodate a yellow toner, a magenta toner, a cyan toner and a black toner, respectively. In this embodiment, the toner image is formed by an image portion exposure and a reverse development. That is, the toner charged to the same polarity (negative in this embodiment) as a charge polarity of the photosensitive drum 1 is deposited on an exposed portion of the photosensitive drum 1 where an absolute value of the potential is lowered by exposing to light the surface of the photosensitive drum 1 after the photosensitive drum 1 is uniformly charged. Incidentally, a toner for being supplied to the developing device 4 is accommodated in a toner supplying container 8 and is appropriately supplied to the developing device 4.

As a second image bearing member, an intermediary transfer belt 5 which is an intermediary transfer member constituted by an endless belt is provided under the photosensitive drums 1Y, 1M, 1C and 1K of the image forming portions SY, SM, SC and SK. The intermediary transfer belt 5 is extended around and stretched by a plurality of supporting rollers (stretching members) including a driving roller 22, a tension roller 21, and an inner secondary transfer roller 23. In this embodiment, an urging roller 25 is further provided in an inner peripheral surface side of the intermediary transfer belt 5, but this will be described later specifically. The urging roller 25 is not included in the plurality of supporting roller. The intermediary transfer belt 5 is rotationally driven (fed) by the driving roller 22 in an arrow R5 direction in FIG. 1. In the inner peripheral surface side of the intermediary transfer belt 5, the above-described primary transfer rollers 6Y, 6M, 6C and 6K are disposed at positions corresponding to the photosensitive drums 1Y, 1M, 1C and 1K, respectively. Each primary transfer roller 6 is supported by an urging mechanism in order to transfer the toner image from the photosensitive drum 1 onto the intermediary transfer belt 5 by an electric action and an urging force. The intermediary transfer belt 5 is urged toward an associated photosensitive drum 1 by the primary transfer roller 6, whereby a primary transfer portion (primary transfer nip) T1 where the photosensitive drum 1 and the intermediary transfer belt 5 contact each other is formed. Further, in the outer peripheral surface side of the intermediary transfer belt 5, at a position corresponding to the inner secondary transfer roller 23, an outer secondary transfer roller 24 is provided. The intermediary transfer belt 5 is urged toward the inner secondary transfer roller 24 by the outer secondary transfer roller 24, so that a secondary transfer portion (secondary transfer nip) T2 where the outer secondary transfer roller 24 and the intermediary transfer belt 5 contact each other is formed. Further, in the outer peripheral surface side of the intermediary transfer belt 5, at a position corresponding to the driving roller 22, a belt cleaner 16 as an intermediary transfer member cleaning means is provided.

The toner image formed on the photosensitive drum 1 as described above is electrostatically transferred (primary-transferred) onto the intermediary transfer belt 5 at the primary transfer portion T1. At this time, to the primary transfer roller 6, a primary transfer bias (primary transfer voltage) of an opposite polarity (positive in this embodiment) to a charge polarity (normal charge polarity) of the toner during the development is applied. For example, during full-color image formation, the color toner images of yellow, magenta, cyan and black formed on the photosensitive drums 1Y, 1M, 1C and 1K are successively primary-transferred superposedly onto the intermediary transfer belt 5. The toners (primary-transfer residual toners) remaining on the surfaces of the photosensitive drums 1 after the transfer step are removed and collected from the surfaces of the photosensitive drums 1 by the drum cleaners 7.

The toner images formed on the intermediary transfer belt 5 are fed to the secondary transfer portion T2 with rotation of the intermediary transfer belt 5. On the other hand, the recording material P, such as paper or a transparent film, accommodated in a cassette 12 or 16 is fed by a feeding roller 13 or 14 and then is fed to a registration roller pair 15 by conveying rollers or the like. This recording material P is supplied to the secondary transfer portion T2 by being timed to the toner images on the intermediary transfer belt 5. The recording material P fed by the registration roller pair 15 is guided to the secondary transfer portion T2 by a guiding member 26 provided upstream of the secondary transfer portion T2 with respect to the feeding direction of the recording material P. The guiding member 26 is disposed in the front surface side of the intermediary transfer belt 5 and includes an upper guiding portion 26*a* for regulating behavior such that the recording material P approaches the surface of the intermediary transfer belt 5. Further, the guiding member is disposed opposed to the upper guiding portion 26*a* and includes a lower guiding portion 26*b* for regulating behavior such that the recording material P is spaced from the surface of the intermediary transfer belt 5.

At the secondary transfer portion T2, the toner images on the intermediary transfer belt 5 are electrostatically transferred (secondary-transferred) onto the recording material P. At this time, to the outer secondary transfer roller 24, a secondary transfer bias (secondary transfer voltage) of an opposite polarity to the normal charge polarity of the toner is applied. The toners (secondary-transfer residual toners) remaining on the surface of the intermediary transfer belt 5 after the secondary transfer step are removed and collected from the surface of the intermediary transfer belt 5 by the belt cleaner 16.

The recording material P on which the toner images are transferred is fed to a fixing device 9 and is sandwiched and fed between a fixing roller 9*a* and a pressing roller 9*b* and thus is heated and pressed, so that the toner images are fixed on the recording material P. Thereafter, the recording material P is discharged (outputted) to an outside of an apparatus main assembly of the image forming apparatus 100.

2. Structure of Intermediary Transfer Belt and Members Relating to Transfer

Next, a structure of the intermediary transfer belt 5 and members relating to the primary transfer and the secondary transfer will be specifically described.

As described above, the intermediary transfer belt 5 is extended around and stretched by the plurality of supporting rollers including the driving roller 22, the tension roller 21 and the inner secondary transfer roller 23. The intermediary transfer belt 5 is formed of a resin material in a single-layer structure or a multi-layer structure, and as the intermediary transfer belt 5, an intermediary transfer belt of 40 μm or more in thickness, 1.0 GPa or more in Young's modulus and $1.0\times10^{9}$-$1.0\times10^{13}$ Ω/square in surface resistivity may preferably be used. In this embodiment, the intermediary transfer belt 5 is constituted by an 85 μm-thick polyimide resin film as a base material, and an electric resistance of the intermediary transfer belt 5 is adjusted by dispersing carbon black into the base material so that the intermediary transfer belt 5 is $1.0\times10^{11}$ Ω/square in surface resistivity and $1.0\times10^{9}$ Ω·cm in volume resistivity. However, the intermediary transfer belt 5 is not limited thereto, but for example, also an intermediary transfer belt of $1.0\times10^{9}$-$1.0\times10^{14}$ in surface resistivity ($1.0\times10^{7}$-$1.0\times10^{12}$ Ω·cm in volume resistivity) and 45-100 μm in thickness can be similarly used.

In this embodiment, the driving roller 22 is a rubber roller including a core metal (formed of metal) and an electroconductive rubber layer as a surface layer. The driving roller 22 has an electric resistance of $1.0\times10^3$-$1.0\times10^5\Omega$ (under application of a voltage of 100 V), and the core metal is electrically grounded.

In this embodiment, the tension roller 21 is a metal(-made) roller. The tension roller 21 is urged from an inner peripheral surface side toward an outer peripheral surface side of the intermediary transfer belt 5 at both end portions thereof with respect to a rotational axis direction thereof by a tension spring 27 ((*a*) of FIG. 6) which is an elastic member as an urging means (urging roller urging means). The tension roller 21 is an example of an upstream roller, of the plurality of supporting rollers for supporting the intermediary transfer belt 5, disposed downstream of the image forming portions S and upstream of the inner secondary transfer roller 23 with respect to the feeding direction (movement direction) of the intermediary transfer belt 5.

In this embodiment, the inner secondary transfer roller 23 is a solid roller including an electroconductive rubber layer as a surface layer. An outer diameter of the inner secondary transfer roller 23 is 20 mm as an example, and will be specifically described later.

In this embodiment, the outer secondary transfer roller 24 is a sponge roller and includes a core metal of SUS (stainless steel) and an electroconductive sponge rubber (sponge layer) formed as a surface layer on the core metal. An outer diameter of the outer secondary transfer roller 24 is 24 mm as an example, and the core metal is 12 mm in diameter and the sponge layer is 6 mm in thickness. The outer secondary transfer roller 24 has an electric resistance of $5.0\times10^7\Omega$. In this embodiment, the sponge layer is 30 degrees in Asker C hardness, but is not limited thereto. The outer secondary transfer roller 24 is disposed so as to be shifted (offset) toward an upstream side relative to the inner secondary transfer roller 23. A shift amount of the outer secondary transfer roller 24 is 3 mm as an example, and will be specifically described later. Further, the outer secondary transfer roller 24 is urged against the surface of the intermediary transfer belt 5 toward the inner secondary transfer roller 23 in a substantially perpendicular direction at both end portions thereof with respect to a rotational axis direction thereof by a spring (not shown) which is an elastic member as an urging means. In this embodiment, the outer secondary transfer roller 24 is pressed by a total pressure of 6.5 kgf. In this embodiment, the outer secondary transfer roller 24 contacts the intermediary transfer belt 5 toward the inner secondary transfer roller 23. By disposing the outer secondary transfer roller 24 so that the outer secondary transfer roller 24 is shifted toward the upstream side relative to the inner secondary transfer roller 23, as described later, it is possible to improve a transfer property of the toner image onto a recording material P having a relatively low smoothness as described later. Further, it is possible to improve a separation property of thin paper of, e.g., 60 gsm or less in basis weight at the secondary transfer portion T2.

In this embodiment, a secondary transfer means for forming an electric field for transferring the toner image from the intermediary transfer belt 5 onto the recording material P at the secondary transfer portion T2 is constituted by the inner secondary transfer roller 23 and the outer secondary transfer roller 24. In this embodiment, to the outer secondary transfer roller 24, the secondary transfer bias of the opposite polarity to the normal charge polarity of the toner is applied, and the inner secondary transfer roller 23 is electrically grounded. As another method, to the inner secondary transfer roller 23, the secondary transfer bias of the same polarity as the normal charge polarity of the toner may be applied, and the outer secondary transfer roller may be electrically grounded.

In the inner peripheral surface side of the intermediary transfer belt 5, the primary transfer rollers 6Y, 6M, 6C and 6K are disposed. In this embodiment, each primary transfer roller 6 is constituted by coating a cylindrical member formed of electroconductive metal in a diameter of 8 mm with an elastic layer of an electroconductive foam member having an electric resistance value of $5.0\times10^6$ Ω/cm and a thickness of 1.0 mm. The primary transfer roller 6 is 300 g in weight and is urged vertically upwardly (toward the photosensitive drum 1) by a spring (not shown) which is an elastic member as an urging means at both end portions thereof with respect to a rotational axis direction thereof. In this embodiment, the primary transfer roller 6 is pressed at a total pressure of 1.5 kgf. Further, in this embodiment, the primary transfer roller 6 is disposed so that a vertical line passing through a rotation center thereof (substantially perpendicular to the surface of the intermediary transfer belt 5 is shifted to a side downstream of a vertical line passing through a rotation center of the photosensitive drum 1 (substantially perpendicular to the surface of the intermediary transfer belt 5. In this embodiment, a shift amount of the primary transfer roller 6 is 2.5 mm.

In this embodiment, the belt cleaner 16 includes a belt cleaning blade as a cleaning member provided in contact with the intermediary transfer belt 5. The belt cleaning blade is pressed by a spring (not shown) which is an elastic member as an urging means so that a contact angle (formed between itself and a tangential line of the intermediary transfer belt 5) is 17° with respect to a counter direction against the feeding direction of the intermediary transfer belt 5.

In this embodiment, a feeding speed (process speed) of the intermediary transfer belt 5 was 350 mm/sec, and a moving speed (peripheral speed) of the photosensitive drum 1 was 351 mm/sec.

Further, in this embodiment, in the inner peripheral surface side of the intermediary transfer belt 5, the urging roller (auxiliary roller) 25 for urging the intermediary transfer belt 5 from the inner peripheral surface side toward the outer peripheral surface side is provided upstream of and adjacent to the inner secondary transfer roller 23 and downstream of the tension roller 21 with respect to the feeding direction of the intermediary transfer belt 5. In this embodiment, the urging roller 25 is a roller formed of SUS and is rotatably supported by bearings, and is rotated with feeding (movement) of the intermediary transfer belt 5 in a contact state with the intermediary transfer belt 5. An outer diameter of the urging roller 25 is 6 mm as an example and will be specifically described later. The urging roller 25 causes the intermediary transfer belt 5 to project toward the outer peripheral surface side at a predetermined position and thus holds an attitude of the intermediary transfer belt 5 in the neighborhood of a portion upstream of the secondary transfer portion T2. As a result, it is possible to improve a transfer property of the toner image onto the recording material P having the relatively low smoothness. Arrangement and action of the urging roller 25 will be described later specifically.

Incidentally, in this embodiment, rotational axis directions of the driving roller 22, the tension roller 21 and the inner secondary transfer roller 23 which are provided as the plurality of supporting rollers for supporting the intermediary transfer belt 5 are substantially parallel to each other. Further, rotational axis directions of the plurality of supporting rollers 21, 22 and 23, the urging roller 25 and the outer secondary transfer roller 24 are also substantially parallel to each other.

3. Arrangement and Action of Urging Roller

Next, the arrangement and the action of the urging roller 25 will be specifically described.

Figure 2:
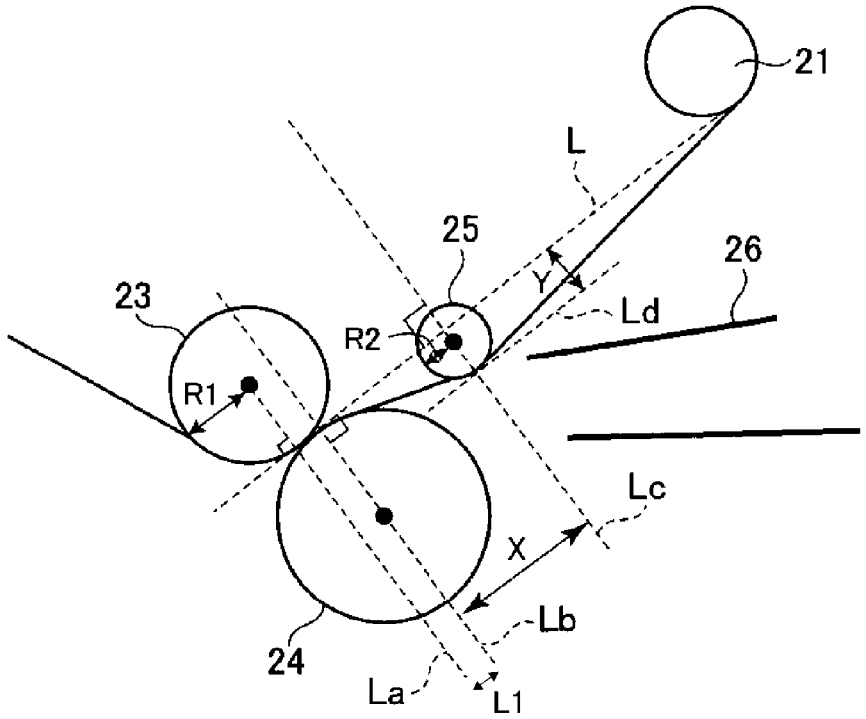
FIG. 2 is a schematic longitudinal sectional view of a neighborhood of a secondary transfer portion.

FIG. 2 is a schematic longitudinal sectional view of a neighborhood of the secondary transfer portion T2, a cross section of which is substantially perpendicular to the rotational axis direction of the inner secondary transfer roller 23. In FIG. 2, an outer common tangential line between the inner secondary transfer roller 23 and the tension roller 21 in a side where the intermediary transfer belt 5 as extended is a reference line L. Further, a rectilinear line passing through a rotation center of the inner secondary transfer roller 23 and substantially perpendicular to the reference line L is an inner roller center line La. Further, a rectilinear line passing through a rotation center of the outer secondary transfer roller 24 and substantially perpendicular to the reference line L is an outer roller center line Lb. Further, a rectilinear line passing through a rotation center of the urging roller 25 and substantially perpendicular to the reference line L is an urging roller center line Lc. Further, a tangential line of the intermediary transfer belt 5 substantially parallel to the reference line L and at a position corresponding to the urging roller 25 is an urging portion tangential line Ld.

Further, a distance between the inner roller center line La and the outer roller center line Lb is L1 (mm) with the proviso that L1 is a positive value when the outer roller center line Lb is positioned downstream of the inner roller center line La with respect to the feeding direction (movement direction) of the intermediary transfer belt 5. Further, a distance between the outer roller center line Lb and the urging roller center line Lc is X (mm). Further, a distance between the reference line L and the urging portion tangential line Ld is Y (mm). Further, a radius of the inner secondary transfer roller 23 is R1 (mm), and a radius of the urging roller 25 is R2 (mm). Incidentally, in a constitution of a representative example of which an evaluation result shown in Table 1 appears hereinafter, the radius R1 of the inner secondary transfer roller 23 is 10 mm, the radius R2 of the urging roller 25 is 3 mm, and a radius of the outer secondary transfer roller 24 is 12 mm. Further, in the constitution, L1 is 3 mm.

The distance L1 corresponds to the shift amount of the outer secondary transfer roller 24 relative to the inner secondary transfer roller 23 (hereinafter also referred to as the "shift amount L1"). Further, the distance X corresponds to a spacing distance of the urging roller 25 from the secondary transfer portion T2 (hereinafter also referred to as the "spacing distance X"). Further, the distance Y corresponds to an entering amount of the urging roller 25 into the intermediary transfer belt 5 (hereinafter also referred to as the "entering amount Y").

A transfer property onto the recording material P having the relatively low smoothness and image defect at a leading end portion and a trailing end portion of the recording material P having relatively high stiffness were evaluated by changing the presence or absence of the urging roller 25 and positions (spacing distance X, entering amount Y) of the urging roller 25. In this case, the recording material P having the relatively low smoothness is also referred to as "low smoothness paper". Further, the recording material P having the relatively high stiffness is also referred to as "thick paper". However, the recording material P is not limited to paper.

For the evaluation of the transfer property onto the low smoothness paper, as an example of the low smoothness paper, paper of 15-20 degrees in Bekk smoothness ("HammerMill Great White Copy Paper", LTR size, basis eight: 75 gsm, from which only paper having low smoothness is extracted) was used. As an image for evaluation, both of a two-color solid image (e.g., a superposed image of magenta and cyan, image density: 1.65) and a halftone image were used. The transfer property onto the low smoothness paper was evaluated in the following manner. The case where the image (pattern) was transferred uniformly on an entire surface of the recording material P was evaluated as "Good (o)", and the case where the image (pattern) was not transferred onto a recessed portion of the recording material P was evaluated as "Poor (x)". Further, a level at which the image (pattern) was not transferred onto the recessed portion of the recording material P in some instances and at which there was a possibility that the transfer property was problematic was evaluated as "Somewhat Poor (Δ)".

On the other hand, for evaluation of the image defect at the leading end portion and the trailing end portion of the thick paper, as an example of the thick paper, paper ("i-best", basis weight: 310 gsm) was used. As an image for evaluation, the halftone image was used. The image defect at the leading end portion and the trailing end portion of the thick paper was evaluated in the following manner. The case where disturbance and white void of the image did not generate was evaluated as "Good (o)", and the case where the disturbance and the white void of the image generated was evaluated as "Poor (x)".

A result of the evaluations is shown in Table 1.

TABLE 1

| | | | LSP*1 | | TP*4 | |
|---|---|---|---|---|---|---|
| Setting | X | Y | TCSI*2 | HTI*3 | LE*5 | TE*6 |
| 1 | — | — | x | x | x | x |
| 2 | 10 | 1 | ○ | ○ | x | x |
| 3 | 15 | 1 | ○ | ○ | ○ | ○ |
| 4 | 16 | 1 | ○ | ○ | ○ | ○ |
| 5 | 20 | 1 | ○ | ○ | ○ | ○ |
| 6 | 25 | 1 | Δ | Δ | ○ | ○ |
| 7 | 30 | 1 | x | x | ○ | ○ |
| 8 | 35 | 1 | x | x | ○ | ○ |
| 9 | 37 | 1 | x | x | ○ | ○ |
| 10 | 38 | 1 | x | x | ○ | ○ |
| 11 | 42 | 1 | x | x | ○ | ○ |
| 12 | 20 | 0.3 | x | x | ○ | ○ |
| 13 | 20 | 0.5 | Δ | Δ | ○ | ○ |
| 14 | 20 | 0.6 | ○ | ○ | ○ | ○ |
| 15 | 20 | 1.5 | ○ | ○ | ○ | ○ |
| 16 | 20 | 2 | ○ | ○ | ○ | ○ |
| 17 | 20 | 3 | ○ | ○ | ○ | ○ |
| 18 | 20 | 3.5 | ○ | ○ | ○ | ○ |
| 19 | 20 | 3.6 | ○ | ○ | x | x |
| 20 | 20 | 4 | ○ | ○ | x | x |
| 21 | 20 | 4.5 | ○ | ○ | x | x |

*1"LSP" is low smoothness paper with a smoothness of 15-20 degrees.
*2"TCSI" is a two-color solid image.
*3"HTI" is a halftone image.
*4"TP" is a thick paper of 310 gsm in basis weight.
*5"LE" is a leading end (portion).
*6"TE" is a trailing end (portion).

From Table 1, it is understood that the transfer property onto the low smoothness paper is improved when the entering amount Y is increased (Setting 12-21) but is lowered when the spacing distance X is excessively increased (Setting 2-11). Further, it is understood that the image defect at the leading end portion and the trailing end portion of the thick paper is liable to generate when the entering amount Y is excessively increased (Setting 12-21) or the spacing distance X is excessively increased (Setting 2-11).

Figure 3:
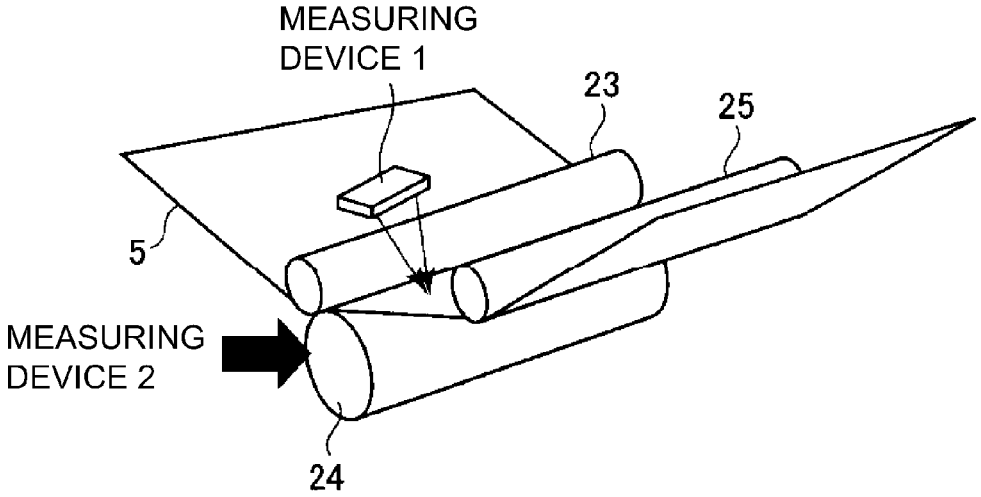
FIG. 3 is an illustration of a measuring system for observing a change in attitude of an intermediary transfer belt in the neighborhood of the secondary transfer portion.

The following observation was made correspondingly to the above-described evaluation experiment. As shown in FIG. 3, a laser displacement meter (measuring device 1) was provided in the inner peripheral surface side of the intermediary transfer belt 5, and displacement of the intermediary transfer belt 5 in the side upstream of the secondary transfer portion T2 was observed. At the same time, the side upstream of the secondary transfer portion T2 was observed through a high-speed camera (shutter speed: 1/5000 sec, image resolving paper: 19 μm) (measuring device 2) from a side-surface side of the intermediary transfer belt 5.

On the basis of a result of the above observation, the evaluation result of the transfer property onto the low smoothness paper will be further described.

Figure 13:
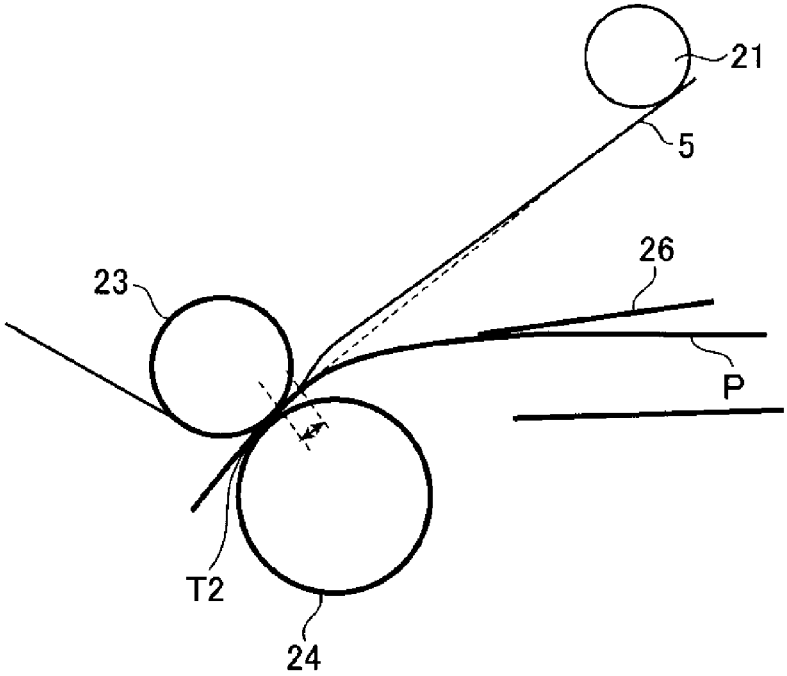
FIG. 13 is a schematic longitudinal sectional view for illustrating a close contact region between the intermediary transfer belt and the recording material in the neighborhood of the secondary transfer portion.

In a constitution in which the transfer property onto the low smoothness paper was not improved, it was confirmed that the recording material P and the intermediary transfer belt 5 were in a state in which a close contact property therebetween was not ensured. That is, in such a constitution, by the observation through the laser displacement meter, when the recording material P was sandwiched at the secondary transfer portion T2, it was confirmed that the attitude of the intermediary transfer belt 5 was changed toward the inner peripheral surface side. Further, in such a constitution, by the observation through the high-speed camera from the side-surface direction, it was confirmed that a close contact region between the recording material P and the intermediary transfer belt 5 was relatively narrow. These phenomena were conspicuous in the case where the urging roller 25 was not provided. FIG. 13 schematically shows an observation result in such a constitution.

Figure 12:
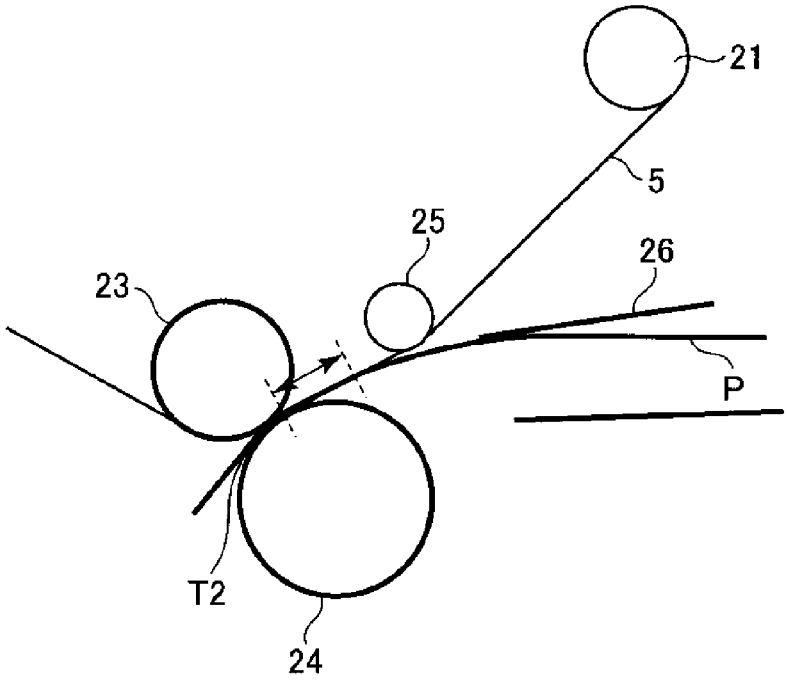
FIG. 12 is a schematic longitudinal sectional view for illustrating a close contact region between the intermediary transfer belt and the recording material in the neighborhood of the secondary transfer portion.

On the other hand, for example, in a constitution in which the transfer property onto the low smoothness paper was improved as in the setting 5, by the observation through the laser displacement meter, it was confirmed that a difference between the attitude of the intermediary transfer belt 5 in a state in which the recording material P was not in the secondary transfer portion T2 and the attitude of the intermediary transfer belt 5 in a state in which the recording material P was in the secondary transfer portion T2 was small. Further, in such a constitution, by the observation through the high-speed camera from the side-surface direction, it was confirmed that the close contact region between the recording material P and the intermediary transfer belt 5 was relatively broad. FIG. 12 schematically shows an observation result in such a constitution.

Figure 4:
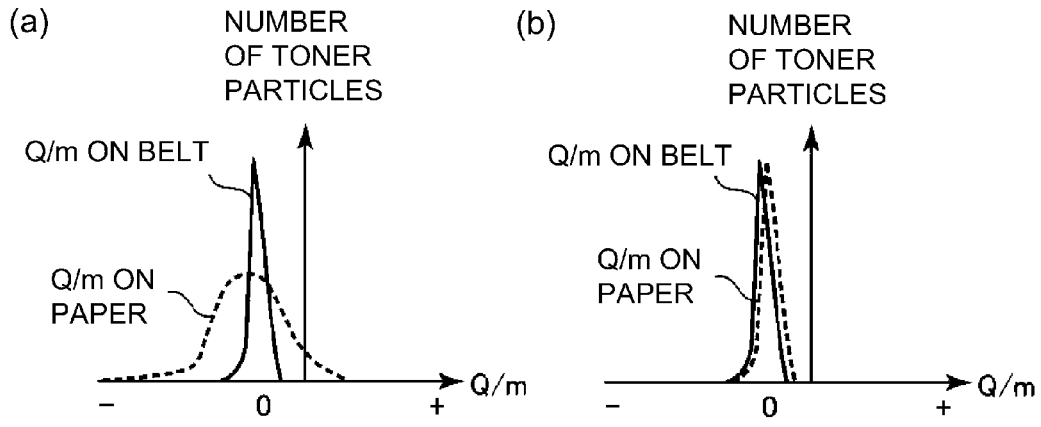
In FIG. 4, (*a*) and (*b*) are graphs each showing a charge amount distribution of a toner on the intermediary transfer belt and an unfixed toner on a recording material.

The influence of the electric discharge on the toner at the secondary transfer portion T2 was checked in a constitution (e.g., in a constitution in which the urging roller 25 was not provided) in which the transfer property onto the low smoothness paper was not improved and in a constitution (e.g., the constitution of the setting 5) in which the transfer property onto the low smoothness paper was improved. As a result, in the constitution in which the transfer property was not improved, a relationship in charge amount distribution between the toner on the intermediary transfer belt 5 and the toner transferred on the recording material P in an unfixed state was as shown in (a) of FIG. 4. That is, the charge amount distribution was broadened by the influence of the electric discharge exerted at a periphery of the secondary transfer portion T2. On the other hand, in the constitution in which the transfer property was improved, the relationship in charge amount distribution between the toner on the intermediary transfer belt 5 and the toner transferred on the recording material in the unfixed state was as shown in (*b*) of FIG. 4. That is, a change in charge amount distribution was very small. This would be considered due to a difference in degree of the influence of the electric discharge exerted in the side upstream of the secondary transfer portion T2.

Figure 11:
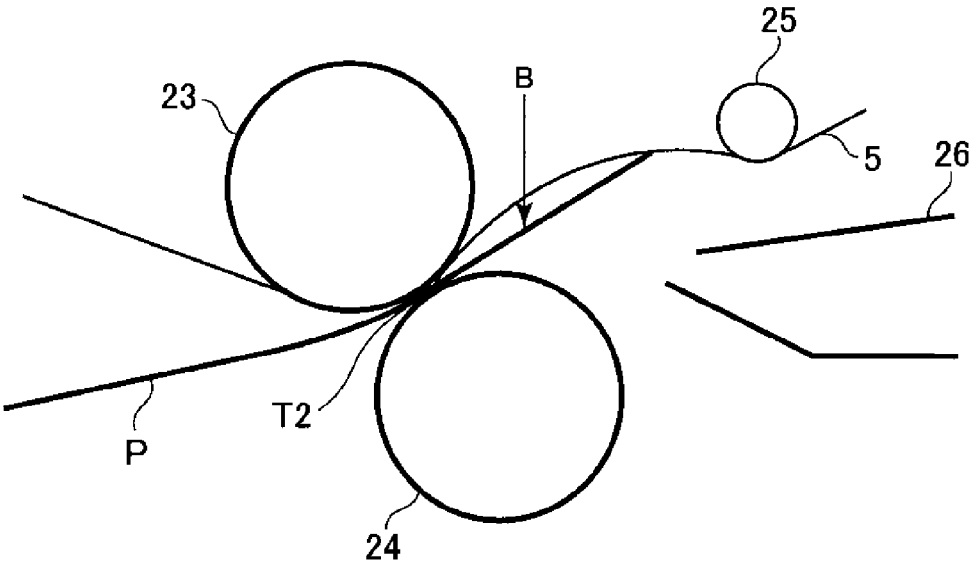
FIG. 11 is a schematic longitudinal sectional view for illustrating the behavior of the recording material in the neighborhood of the secondary transfer portion.

Next, on the basis of the above-described observation result, the evaluation of the image defect at the leading end portion and the trailing end portion of the thick paper will be further described. For example, in a constitution of the setting 20 in which the image defect at the leading end portion and the trailing end portion of the thick paper generated, by the observation through the high-speed camera from the side-surface direction, as shown in FIG. 11, a phenomenon that the leading end portion and the trailing end portion of the recording material P and the intermediary transfer belt 5 temporarily separated from each other (portion of an arrow B in FIG. 11) was confirmed. Incidentally, in the case where the urging roller 25 was not provided (Setting 1), as shown in FIG. 13, the close contact region between the intermediary transfer belt 5 and the recording material P is relatively narrow, so that the surface of the intermediary transfer belt 5 is largely deformed in the inner peripheral surface direction. For that reason, not only at the leading end portion and the trailing end portion of the recording material P, but also even at a central portion of the recording material P with respect to the feeding direction of the recording material P, in the case where the secondary transfer bias was 3000 V or more, it was confirmed that the toner was subjected to the electric discharge in the side upstream of the secondary transfer portion T2 and thus the white void due to inversion of the charge polarity of the toner generated.

On the other hand, e.g., in the constitution of the setting 5 in which the image defect at the leading end portion and the trailing end portion of the thick paper did not generate, it was confirmed that floating of the intermediary transfer belt 5 from the leading end portion and the trailing end portion of the recording material P as shown in FIG. 11 did not generate or that an amount of the floating was small compared with the case where the image defect generated.

The evaluation experiments and observations as described above were conducted by changing outer diameters of the urging roller 25, the inner secondary transfer roller 23 and the outer secondary transfer roller 24. A result thereof is shown in FIG. 5.

Figure 5:
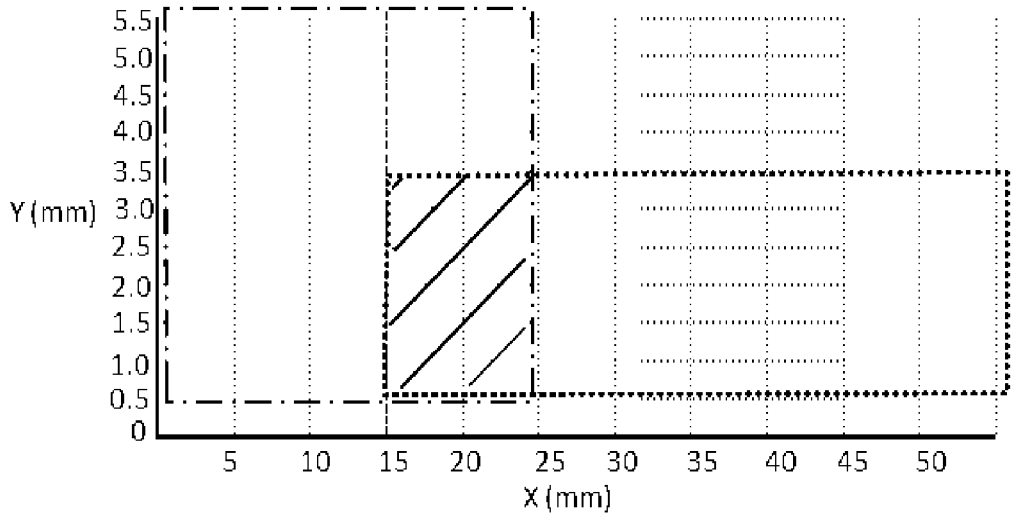
FIG. 5 is a graph showing a relationship between a spacing distance X and an entering amount Y of an urging roller.

In FIG. 5, a region enclosed by a chain line is a region where the transfer property onto the low smoothness paper is good (o), and a region enclosed by a dotted line is a region where the image defect at the leading end portion and the trailing end portion of the thick paper does not generate (o). Further, in FIG. 5, a hatched region is a region where the image defect at the leading end portion and the trailing end portion of the thick paper can be suppressed while improving the transfer property onto the low smoothness paper.

However, as is understood from the result of Table 1, a possible range of the spacing amount (distance) X is limited by the radius R1 of the inner secondary transfer roller 23, the radius R2 of the urging roller 25 and the shift amount L1. Specifically, the spacing amount X is required to be larger than $(((R1+R2)^2-(R1-R2)^2)^{1/2}-L1)+7$ mm. That is, $X=(((R1+R2)^2-(R1-R2)^2)^{1/2}-L1)$ shows a state in which the inner secondary transfer roller 23 and the urging roller 25 contact each other, in the above-described constitution of the representative example, $(((R1+R2)^2-(R1-R2)^2)^{1/2}-L1)=7.9$ mm. Further, in a range in which R1, R2 and L1 satisfy; 18 mm$>(((R1+R2)^2-(R1-R2)^2)^{1/2}-L1)$, as shown in Table 1, in the case of X=15 or more, the image defect at the leading end portion and the trailing end portion of the thick paper did not generate while improving the transfer property onto the low smoothness paper.

From the above, it was found that the position of the urging roller 25 capable of suppressing the image defect at the leading end portion and the trailing end portion of the thick paper while improving the transfer property onto the low smoothness paper is a position where all of the following relationships are satisfied:

$$L1>0 \text{ mm},$$

$$25 \text{ mm}>X>(((R1+R2)^2-(R1-R2)^2)^{1/2}-L1)+7 \text{ mm},$$

and $$3.5 \text{ mm}\geq Y>0.5 \text{ mm}.$$

Here, in the case of $L1\leq 0$, deformation of the intermediary transfer belt 5 in the side upstream of the secondary transfer portion T2 is not observed, and therefore the image defect at the leading end portion and the trailing end portion of the thick paper does not generate. However, the recording material P and the intermediary transfer belt 5 cannot be closely contacted to each other in the side upstream of the secondary transfer portion T2, and therefore the transfer property onto the low smoothness paper is not improved. Incidentally, L1 is a distance between a point of intersection of a tangential line between the tension roller 21 and the outer secondary transfer roller 24 and a perpendicular line passing through a center of the inner secondary transfer roller 23 and perpendicular to the tangential line and a point of contact of the tangential line with the outer secondary transfer roller 24. The case of $L1\leq 0$ means that the outer secondary transfer roller 24 is not shifted relative to the inner secondary transfer roller 23 or is shifted toward a side downstream of the inner secondary transfer roller 23. On the other hand, the case of $L1>0$ means that the outer secondary transfer roller 24 is shifted toward a side upstream of the inner secondary transfer roller 23.

4. Arrangement of Tension Roller

Next, a relationship between arrangement of the tension roller 21 and suppression of the image defect at the leading end portion and the trailing end portion of the thick paper will be described.

In the case where the thick paper was used as the recording material P, it turned out that the following constitution is advantageous in that the image defect at the leading end portion and the trailing end portion of the recording material P due to a temporary non-contact state between the intermediary transfer belt 5 and the recording material P is suppressed. That is, as in this embodiment, the constitution in which the position of the tension roller 21 for imparting tension to the intermediary transfer belt 5 is in a side downstream of the primary transfer portions T1 (specifically, downstream of a most downstream primary transfer portion T1K) and upstream of the secondary transfer portion T2 is employed.

Figure 6:
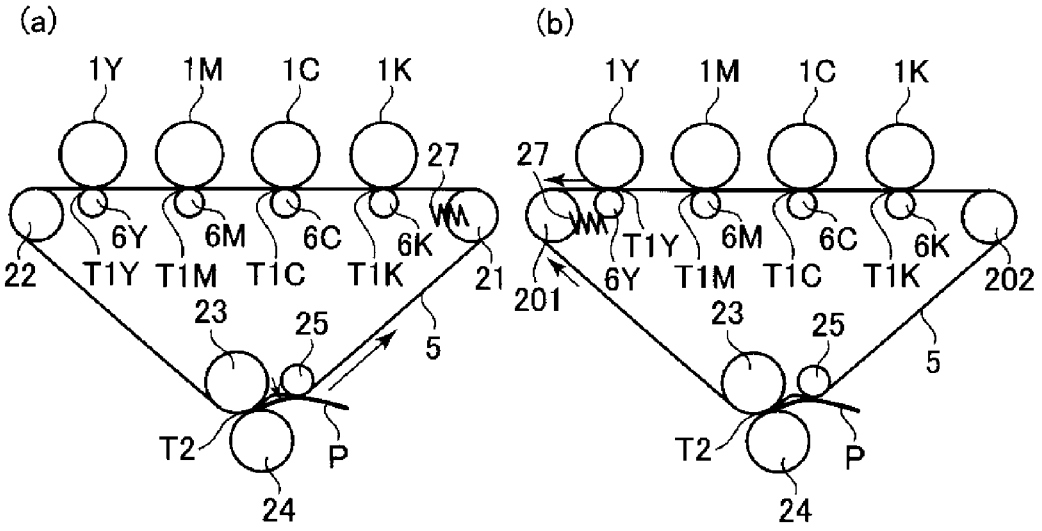
In FIG. 6, (*a*) and (*b*) are schematic views for illustrating a position of a tension roller for the intermediary transfer belt.

That is, in this embodiment, as shown in (*a*) of FIG. 6, the tension roller 21 is disposed in the side downstream of the primary transfer portions T1 and upstream of the secondary transfer portion T2. that is, in this embodiment, in a side upstream of the tension roller 21 and downstream of the inner secondary transfer roller 23, the primary transfer rollers 6 contacting the intermediary transfer belt 5 with which the photosensitive drums 1 are contactable are provided. At the instance when the thick paper is sandwiched at the secondary transfer portion T2, the intermediary transfer belt 5 is pushed by the thick paper and thus is likely to float up. However, in the case of arrangement as shown in (*a*) of FIG. 6, a force in a direction in which the intermediary transfer belt 5 is pulled toward the upstream side correspondingly to a length of the floating at that time is exerted by the tension imparted by the tension roller 21. At the primary transfer portions T1, the primary transfer rollers 6 are urged (pressed) toward the photosensitive drums 1, but in the case where the tension roller 21 is positioned downstream of the primary transfer portion, T1, a deformation amount of the intermediary transfer belt 5 is easily absorbed by the tension of the intermediary transfer belt 5.

On the other hand, (b) of FIG. 6 shows a constitution in which a tension roller 201 is disposed in a side upstream of the primary transfer portions T1 (specifically, upstream of an upstreammost primary transfer portion T1Y) and downstream of the secondary transfer portion T2. Incidentally, the tension roller 201 may also function as a driving roller, and a supporting roller 202 positioned correspondingly to the tension roller 21 in this embodiment may also be the driving roller. In the case of arrangement as shown in (*b*) of FIG. 6, the tension imparted by the tension roller 201 is blocked by the primary transfer portions T1, so that depending on the tension, the recording material P does not readily follow a change in attitude of the intermediary transfer belt 5 at the secondary transfer portion T2.

In the case where the supporting roller disposed upstream of and adjacent to the inner secondary transfer roller 23 is the tension roller 21, an urging force of the tension roller 21 by the urging means may preferably be 2.5 kgf or more and 10 kgf or less. As a result, the deformation amount of the intermediary transfer belt 5 as described above is readily absorbed by the tension imparted by the tension roller 21. In this embodiment, the tension roller 21 is urged by the tension spring 27 as the urging means at each of end portions thereof with respect to the rotational axis direction thereof. In this case, the sum (total pressure) of pressures (urging forces) of the tension springs 27 at the end portions of the tension roller 21 with respect to the rotational axis direction of the tension roller may preferably be 2.5 kgf or more and 10 kgf or less.

5. Locus of Recording Material

Figure 7:
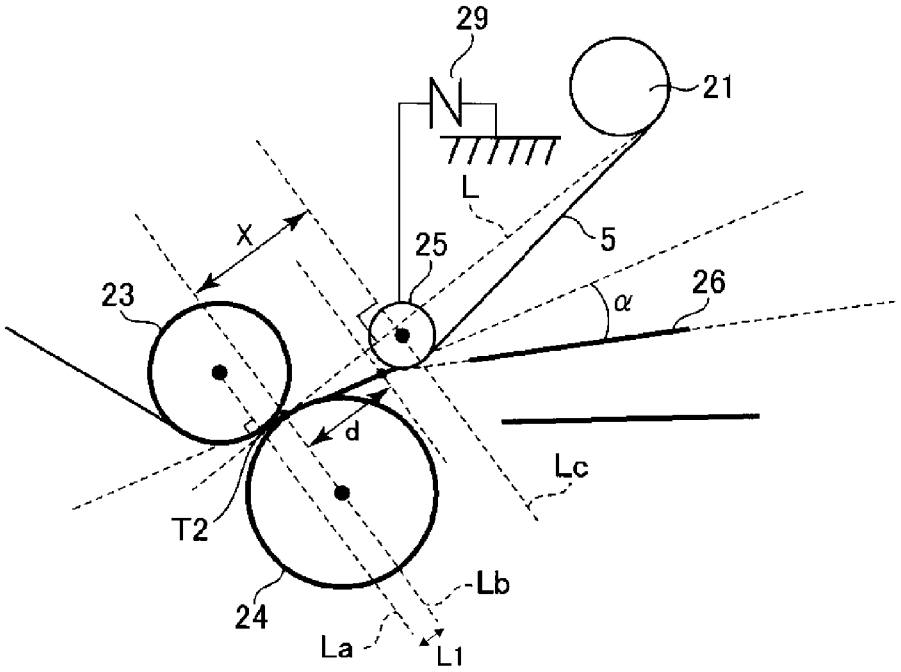
FIG. 7 is a schematic longitudinal sectional view for illustrating a locus of the recording material in the neighborhood of the secondary transfer portion.

Next, with reference to FIG. 7, a locus of the recording material P immediately in front of the secondary transfer portion T2 will be described. FIG. 7 is a schematic longitudinal sectional view, similar to FIG. 2, for illustrating the locus of the recording material P immediately in front of the secondary transfer portion T2.

As shown in FIG. 7, the recording material P may preferably be contacted to the intermediary transfer belt 5 between the outer roller center line Lb and the urging roller center line Lc. That is, a position (contact position) on the intermediary transfer belt where the recording material P starts to contact the intermediary transfer belt 5 is represented by a distance d (mm) (distance with respect to a direction along the reference line L) from the outer roller center line Lb toward the urging roller center line Lc. At this time, a relationship of $0 \text{ mm}<d<X \text{ mm}$ may preferably be satisfied. Further, an acute angle (contact angle) $\alpha$ (°) formed between a tangential line of the intermediary transfer belt 5 and the recording material P at this contact position may preferably satisfy a relationship of $0°<\alpha<15°$. Specifically, the guiding member 26 positioned upstream of the secondary transfer portion T2 can be disposed so as to provide the above-described contact position and contact angle.

By providing the contact position as described above, the recording material P can enter the secondary transfer portion T2 in a state in which the recording material P is closely contacted to the intermediary transfer belt 5 in a side upstream of the secondary transfer portion T2. As a result, the above-described electric discharge in the side upstream of the secondary transfer portion T2 can be suppressed, so that it becomes possible to suppress the image defect due to the electric discharge.

Further, when the angle between the recording material P and the intermediary transfer belt 7 is excessively large ($\alpha>15°$), at the instance when the trailing end portion of the recording material P passes through the end portion of the guiding member 26, a force for causing the recording material P to follow the above-described nip line acts on a portion of the recording material P from a position at the secondary transfer portion T2 to the trailing end portion. This is conspicuous in the case of the recording material P having relatively high stiffness, such as paper of 250 gsm or more in basis weight. For that reason, the recording material P is attracted to the intermediary transfer belt 5, so that the toner image on the intermediary transfer belt 5 is disturbed in some cases. By providing the contact angle as described above, it is possible to suppress such a phenomenon.

Accordingly, in a preferred example, by providing the contact position and the contact angle so as to fall within the above-described ranges, an effect of improving the transfer property onto the low smoothness paper by the urging roller 25 while suppressing the image defect at the leading end portion and the trailing end portion of the thick paper is easily obtained.

6. Electrical Property of Urging Roller

Next, with reference to FIG. 7, an electrical property of the urging roller 25 will be described.

In this embodiment, the urging roller 25 is formed of SUS which is an electroconductive material. The urging roller 25 may preferably be electrically grounded (connected to the ground potential (ground)) via a resistor 29 such as a varistor. In the case where the urging roller 25 formed of the electroconductive material is electrically grounded without via the resistor, when the secondary transfer bias is applied to the outer secondary transfer roller 24, a current flows into the urging roller 25 depending on the voltage (bias) in some cases. When the current flows into the urging roller 25, a current flowing toward the inner secondary transfer roller 23 decreases, and therefore, a transfer current for transferring the toner (image) onto the recording material P becomes insufficient and a transfer efficiency lowers, so that improper transfer (weak-field transfer error (failure)) generates.

In the case where as the resistor, a constant-voltage element (varistor, Zener diode) is used, for example, when an applied voltage to the outer secondary transfer roller 24 is 0.5-8 kV and a surface resistivity of the intermediary transfer belt 5 is $1.0\times10^{9}$-$1.0\times10^{13}$ Ω/square a constant-voltage element of 1.0 kV or more in varistor voltage (breakdown voltage) may preferably be used. In this embodiment, the urging roller 25 was electrically grounded via a varistor of 1.5 kV in varistor voltage.

As described above, according to this embodiment, it is possible to suppress the image defect at the leading end portion and the trailing end portion of the recording material P having the relatively high stiffness while improving the transfer property of the toner image onto the recording material P having the relatively low smoothness.

Embodiment 2

Next, another embodiment of the present invention will be described. Basic constitutions and operations of the image forming apparatus in this embodiment are the same as those in Embodiment 1. Accordingly, elements having the same or corresponding functions and constitutions are represented by the same reference numerals or symbols and will be omitted from detailed description.

In Embodiment 1, the urging roller 25 was disposed at a fixed position. Further, in Embodiment 1, the description that the tension roller 21 may desirably be disposed downstream of the primary transfer portions T1 and upstream of the secondary transfer portion T2 was made. For the same reason, it is also possible to impart tension to the intermediary transfer belt 5 by the urging roller 25.

Figure 8:
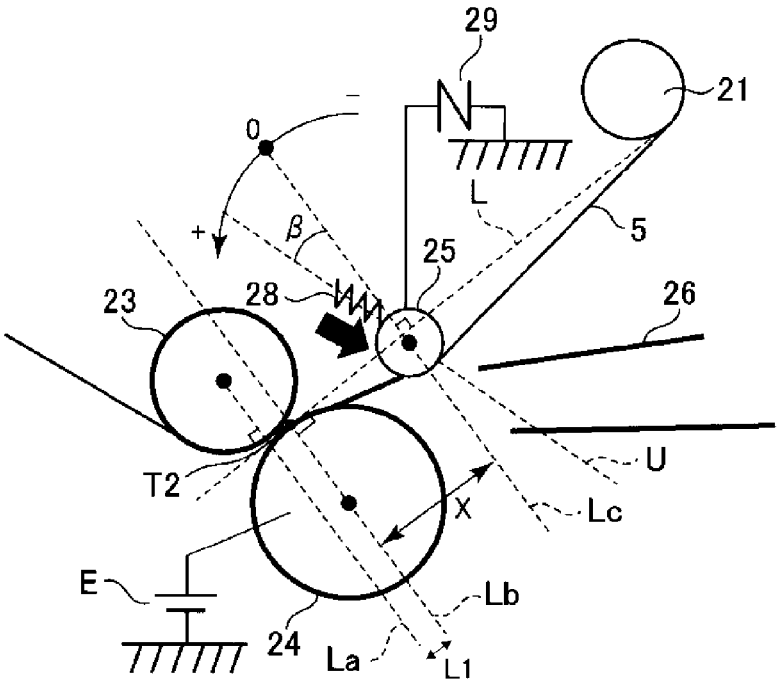
FIG. 8 is a schematic longitudinal sectional view for illustrating an urging direction of the urging roller.
Figure 9:
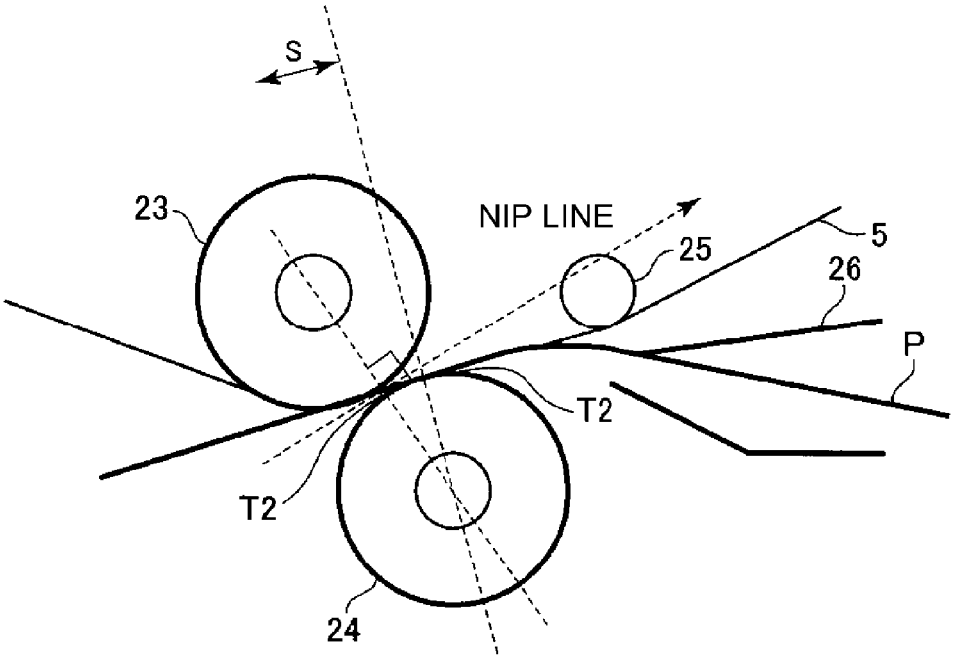
FIG. 9 is a schematic longitudinal sectional view for illustrating behavior of the recording material in the neighborhood of the secondary transfer portion.
Figure 10:
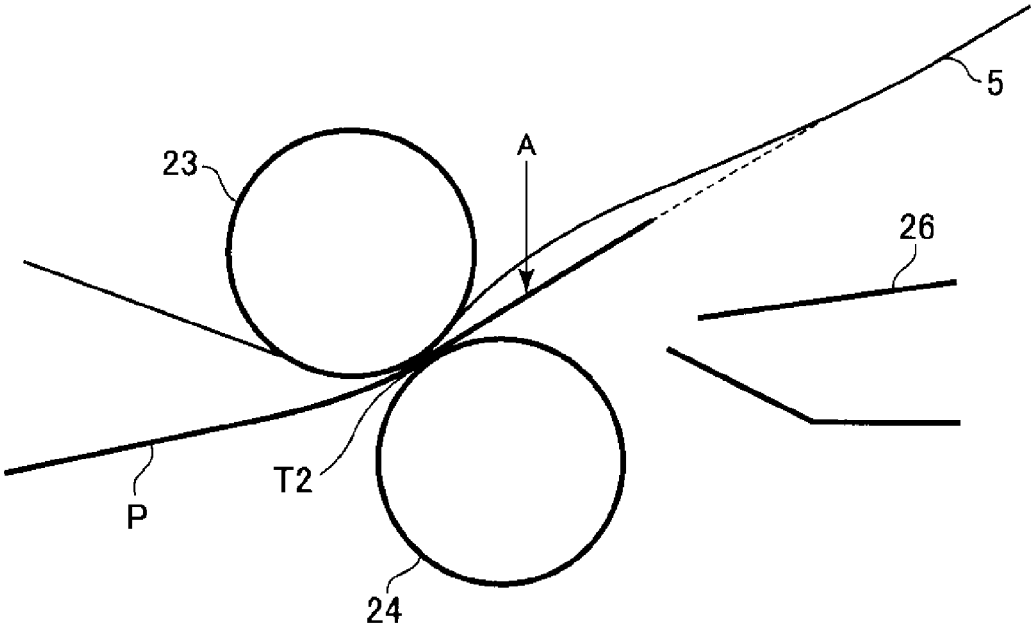
FIG. 10 is a schematic longitudinal sectional view for illustrating the behavior of the recording material in the neighborhood of the secondary transfer portion.

FIG. 8 is a schematic longitudinal sectional view, similar to FIG. 2, of a neighborhood of the secondary transfer portion T2 in this embodiment. The urging roller 25 is urged from the inner peripheral surface side toward the outer peripheral surface side of the intermediary transfer belt 5 by an urging spring 28 which is an elastic member as an urging means (urging roller urging means) at each of end portions thereof with respect to a rotational axis direction thereof.

Here, in FIG. 8, an angle formed between the urging roller center line Lc and an urging direction U of the urging roller 25 by the urging roller spring 28 is β with the proviso that the angle β is a positive value when the urging roller 25 is urged toward an upstream side with respect to the feeding direction of the intermediary transfer belt 5. Further, in this embodiment, the sum (total pressure) of pressures of the urging roller springs 28 at the end portions of the urging roller 25 with respect to the rotational axis direction of the urging roller 25 is an urging force of the urging roller 25 by the urging roller urging spring 28. At this time, similarly as described above in Embodiment 1, the transfer property onto the low smoothness paper and the image defect at the leading end portion and the trailing end portion of the thick paper were evaluated by changing the above-described angle β and urging force. A result thereof is shown in Table 2.

TABLE 2

| Setting | A*1β | TP*2(gf) | TPOLSP*3 | ID*4 |
|---|---|---|---|---|
| 1 | −30 | 1500 | ○ | x |
| 2 | −20 | 1500 | ○ | x |
| 3 | −16 | 1500 | ○ | x |
| 4 | −15 | 1500 | ○ | ○ |
| 5 | −10 | 1500 | ○ | ○ |
| 6 | −5 | 1500 | ○ | ○ |
| 7 | 0 | 1500 | ○ | ○ |
| 8 | 5 | 1500 | ○ | ○ |
| 9 | 10 | 1500 | ○ | ○ |
| 10 | 20 | 1500 | ○ | ○ |
| 11 | 20 | 1500 | ○ | ○ |
| 12 | 40 | 1500 | ○ | ○ |
| 13 | 60 | 1500 | ○ | ○ |
| 14 | 85 | 1500 | ○ | ○ |
| 15 | 15 | 300 | x | ○ |
| 16 | 15 | 500 | x | ○ |
| 17 | 15 | 750 | x | ○ |
| 18 | 15 | 800 | ○ | ○ |
| 19 | 15 | 1000 | ○ | ○ |
| 20 | 15 | 1500 | ○ | ○ |
| 21 | 15 | 3000 | ○ | ○ |
| 22 | 15 | 5000 | ○ | ○ |

*1"A" is the angle (°).
*2"TP" is the total pressure (gf).
*3"TPOLSP" is the transfer property onto the low smoothness paper.
*4"ID" is the image defect at the leading end portion and the trailing end portion of the thick paper.

From Table 2, it is understood that a relationship of −15°<β90° may preferably be satisfied in order to suppress the image defect at the leading end portion and the trailing end portion of the thick paper (Setting 1-14). Incidentally, in Table 2, the result that the angle β is up to 85° is shown, but a good result was obtained until the angle β is 90° which is a limit of inclination of the urging direction. Further, from Table 2, it is understood that the urging force may preferably be 800 gf or more in order to improve the transfer property onto the low smoothness paper (Setting 15-22). Incidentally, the urging force may preferably be smaller than an urging force of the intermediary transfer belt 5 by the tension roller 21, typically 5000 gf or less. Accordingly, in order to not only improve the transfer property onto the low smoothness paper but also suppress the image defect at the leading end portion and the trailing end portion of the thick paper, it is further preferable that the angle β satisfies: $15° < \beta < 90°$ and the urging force is 800 gf or more.

Further, as is understood from Table 2, the case where the urging roller 25 is urged (pressed) toward the upstream side ($\beta \geq 0°$) is advantageous in terms of the suppression of the image defect at the leading end portion and the trailing end portion of the thick paper compared with the case where the urging roller 25 is urged (pressed) toward the downstream side. According to the observation from the side-surface direction similarly as described above in Embodiment 1, in the case where the urging direction extends toward the downstream side, it turned out that there is a tendency that a degree of floating of the intermediary transfer belt 5 from the recording material P increases. On the other hand, in the case where the urging direction extends toward the upstream side, it turned out that the intermediary transfer belt 5 floating from the recording material P is pulled not only in the outer peripheral surface direction of the intermediary transfer belt 5 but also toward the upstream side of the intermediary transfer belt 5 and thus the intermediary transfer belt 5 moves in the outer peripheral surface direction. Consequently, a floating amount of the intermediary transfer belt 5 from the recording material P is suppressed, so that the image defect is readily suppressed. Accordingly, the above-described angle β may preferably satisfy the relationship of $0° \leq \beta < 90°$.

Incidentally, in this embodiment, as shown in (*a*) of FIG. 6, the tension roller 21 is positioned downstream of the primary transfer portions T1 and upstream of the secondary transfer portion T2. However, even in a constitution in which the tension roller 201 is positioned upstream of the primary transfer portions T1 and downstream of the secondary transfer portion T2 as shown in (*b*) of FIG. 6, an effect as described above can be obtained by the tension imparted by the urging roller 25.

As described above, according to this embodiment, an effect similar to that described in Embodiment 1 can be further readily obtained.

Other Embodiments

The present invention was described above based on specific embodiments, but is not limited thereto.

In the above-described embodiments, the effect of the present invention was described using the transfer property onto the low smoothness paper and the image defect at the leading end portion and the trailing end portion of the thick paper as an example, but the present invention is not intended to only form the image on the recording material having the relatively low smoothness or the recording material having the relatively high stiffness. The recording material having the low smoothness and the recording material having the relatively high stiffness are a representative example of the case where the above-described problems of the transfer property and the image defect at the leading end portion and the trailing end portion are liable to generate. Improvement of the transfer property onto the recording material having the relatively low smoothness advantageously acts on also improvement of the transfer property onto a recording material having relatively high smoothness. Further, suppression of the image defect at the leading end portion and the trailing end portion of the recording material having the relatively high stiffness advantageously acts on also suppression of the image defect at the leading end portion and the trailing end portion of a recording material having relatively low stiffness. Accordingly, it is possible to realize improvement of the transfer property onto recording materials of many species including plain paper and suppression of the image defect at the leading end portion and the trailing end portion of the recording materials, so that a range of choice of recording materials usable in the image forming apparatus is broadened.

Further, in the above-described embodiments, the case where the belt-shaped image bearing member was the intermediary transfer belt was described, but the present invention is applicable when an image bearing member constituted by an endless belt for carrying and feeding the toner image is used. Examples of such a belt-shaped image bearing member may include a photosensitive (member) belt and an electrostatic recording dielectric (member) belt, in addition to the intermediary transfer belt in the above-described embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-169854 filed on Aug. 28, 2015, which is hereby incorporated by reference herein in its entirety.

What is claimed is:

1. An image forming apparatus comprising:

a toner image forming portion configured to form a toner image;

a movable endless belt on which the toner image is formed by said toner image forming portion and from which the toner image is transferred onto a recording material at a transfer portion;

a plurality of rollers contacting an inner peripheral surface of said belt and including a first roller, an urging roller and a second roller, wherein said first roller is provided at the transfer portion, said urging roller is provided at a position upstream of and adjacent to said first roller with respect to a movement direction of said belt and urges said belt from the inner peripheral surface toward an outer peripheral surface of said belt, and said second roller is provided at a position upstream of and adjacent to said urging roller and downstream of said toner image forming portion with respect to the movement direction of said belt; and a third roller provided at a position opposing said first roller through said belt, wherein the following relationships are satisfied:

$$25\ (\mathrm{mm}) > X > (((R1+R2)^2-(R1-R2)^2)^{1/2}-L1)+7\ (\mathrm{mm}),$$

$$3.5\ (\mathrm{mm}) \geq Y > 0.5\ (\mathrm{mm}),\ \text{and}$$

$$L1 > 0\ (\mathrm{mm}),$$

wherein as seen in a rotational axis direction of said first roller,

X is a distance (mm) between Lb and Lc, where Lb is a rectilinear line passing through a rotation center of said third roller and perpendicular to an outer common tangential line L between said first roller and said second roller on a side contacting said belt, and Lc is a rectilinear line passing through a rotation center of said urging roller and perpendicular to the outer common tangential line L, R1 is a radius (mm) of said first roller, R2 is a radius (mm) of said urging roller, L1 is a distance (mm) between the rectilinear line Lb and a rectilinear line La passing through a rotation center of said first roller and perpendicular to the outer common tangential line L with the proviso that L1 is a positive value when Lb is positioned upstream of La with respect to the movement direction of said belt, and Y is a distance (mm) between the outer common tangential line L and a tangential line Ld of said urging roller parallel to the outer common tangential line L on a side contacting said belt.

2. An image forming apparatus according to claim 1, wherein said second roller is urged by an urging member from the inner peripheral surface toward the outer peripheral surface of said belt to impart tension to said belt.

3. An image forming apparatus according to claim 2, wherein an urging force of said second roller by said urging member is 2.5 kgf or more and 10 kgf or less.

4. An image forming apparatus according to claim 1, wherein said urging roller is rotated with movement of said belt.

5. An image forming apparatus according to claim 1, wherein said urging roller is formed of an electroconductive material.

6. An image forming apparatus according to claim 5, wherein said urging roller is electrically grounded via a resistor.

7. An image forming apparatus according to claim 6, wherein said resistor is a constant-voltage element of 1.0 kV or more in breakdown voltage.

8. An image forming apparatus according to claim 1, wherein when a contact position which is a position on said belt where the recording material starts to contact said belt is represented by a distance d (mm) from the rectilinear line Lb toward the rectilinear line Lc, the following relationship is satisfied:

$$0\ (\text{mm}) < d < X.$$

9. An image forming apparatus according to claim 8, wherein when an angle formed between a tangential line of said belt at the contact position and a surface of the recording material is α (°), the following relationship is satisfied:

$$0° < \alpha < 15°.$$

10. An image forming apparatus according to claim 1, wherein said urging roller is disposed at a fixing position.

11. An image forming apparatus according to claim 1, wherein said urging roller is urged by an urging roller urging member from the inner peripheral surface toward the outer peripheral surface of said belt, and when an angle formed between the rectilinear line Lc and an urging direction of said urging roller by said urging roller urging member is β (°) with the proviso that the angle β is a positive value when said urging roller is urged toward an upstream side with respect to the movement direction of said belt, the following relationship is satisfied:

$$-15° < \beta < 90°.$$

12. An image forming apparatus according to claim 11, wherein the following relationship is satisfied:

$$0° \leq \beta < 90°.$$

* * * * *